US005213260A

United States Patent [19]

Tonkinson

[11] Patent Number: 5,213,260

[45] Date of Patent: May 25, 1993

[54] NOZZLE FOR PRODUCING LAMINAR FLOW

[76] Inventor: Steven Tonkinson, 1424A Morton Cir., Claremont, Calif. 91711

[21] Appl. No.: 725,547

[22] Filed: Jul. 3, 1991

[51] Int. Cl.[5] ..... B05B 17/04; B05B 17/08

[52] U.S. Cl. ..... 239/11; 239/461; 239/590.3

[58] Field of Search ..... 239/11, 461, 590.3, 239/590.5

[56] References Cited

U.S. PATENT DOCUMENTS 3,630,444 12/1971 Nelson ..... 239/590.3
4,354,635 10/1982 Barnert et al. ..... 239/590.3
4,795,092 1/1989 Fuller ..... 239/590.3
4,811,905 3/1989 Ishikawa et al. ..... 239/590.3

*Primary Examiner*—Andres Kashnikow
*Assistant Examiner*—Lesley D. Morris

[57] ABSTRACT

A nozzle which produces laminar fluid flow, which may be used in fountains and water displays, is disclosed. The nozzle disclosed reduces the turbulence of the fluid flowing through the nozzle by using a material which has randomly-arranged filaments for dividing the velocity components of the incoming fluid stream into smaller components. Some of the velocity components cancel each other thereby presenting a more uniform velocity profile, reducing the turbulence of the fluid, and allowing laminar flow at higher flow rates than would otherwise be possible.

11 Claims, 2 Drawing Sheets

NOZZLE FOR PRODUCING LAMINAR FLOW

BACKGROUND OF INVENTION

1. Field of the Invention

This invention relates to the field of fluid flow devices and nozzles and, especially to nozzles producing a laminar output stream of water. Still more particularly, this invention relates to nozzles capable of producing a laminar trajectory stream suitable for water displays and fountains.

2. Prior Art

Various methods and theories have been used in the past for producing a laminar stream of water or other fluid by reducing the turbulence in a supply stream prior to discharge from a nozzle, spout, or faucet.

Laminar flow is characterized by the smooth and regular flow of fluid in layers. It has, therefore, been naturally assumed that the creation of laminar flow may best be accomplished by forcing the flow stream into a number of small flow paths substantially axial to the flow of the fluid through the body of the device. In this way, the Reynolds number for the flow in each path can be reduced to a value in the laminar region. The Reynolds number is a dimensionless value which indicates whether flow in a particular application can be expected to be laminar or turbulent. The relationship between the Reynolds numbers and the velocity of the stream, the diameter of the flow area, and the kinematic viscosity of the fluid is stated by the following equation:

$$Nr = vD/V$$

where:

Nr = Reynolds Number v = velocity of the stream

D = diameter of the flow area

V = kinematic viscosity of the fluid

For practical applications, a Reynolds number less than 2,000 generally indicates laminar flow and a value over 4,000 predicts turbulent flow. The range between 2,000 and 4,000 is called the critical region and the type of flow cannot be predicted due to the possible influence of outside factors such as pipe roughness. In fact, by minimizing these external disturbances, it is possible to maintain laminar flow for Reynolds number values as high as 50,000.

Since the kinematic viscosity is fixed for water, the only way to reduce the Reynolds number is to minimize the flow path diameter or the velocity. Reducing the diameter of the flow area have most often been accomplished through the use of perforated discs, multiple layers of screens, channels, fins, tubes, etc., placed in the flow path to promote straight and parallel flow in small segments over the flow area of the stream with the net result being the discharge of a larger laminar stream.

Such prior art methods do reduce the amount of turbulence in short streams as required for splashless and silent flow of water in lavatories, drinking fountains, and tubs. However, they are not, in general, suitable for use in fountain displays in which the flow stream must often remain clear, laminar, and coherent, over a trajectory path more than 10 feet high and 15 feet distant. Layered screens act to divide and redirect the flow in a uniform vertical direction but leave room for radial and rotational flow in the spaces between layers which may pass intact through the relatively thin screens or perforated discs, causing turbulence in the stream and requiring a nozzle body of relatively long length.

Other methods used, such as tubes or channels, remove rotational and radial flow, also by dividing and redirecting flow in the axial direction through small flow areas. Fuller, U.S. Pat. No. 4,795,092, discloses a laminar flow fountain nozzle in which a porous foam member having small flow paths therethrough but providing "a very high restriction and very large viscous surfaces to any flow in the tangential direction" is used in conjunction with a flow straightening stack of small tubular members. Such nozzles, however, must rely on a relatively large nozzle body diameter to reduce the velocity components in the axial direction.

Another source of turbulence reduced by the present invention is often introduced at the discharge outlet or orifice. As flow exits the nozzle body through the relatively small flow area of the output stream, it must accelerate. The stream will continue to neck down after exiting the nozzle to a cross-section smaller than that of the nominal stream diameter. This area of minimum cross section is called the "vena contracta." Beyond this point, the stream must decelerate again and expand. This contraction and expansion causes turbulence in the stream and an energy loss. This energy loss and the associated turbulence are dependent upon the geometry of the nozzle discharge outlet. The energy loss is calculated from the equation:

$$H1 = C1(v/2G)$$

where: where:

H1 = energy loss v = velocity of the stream

G = acceleration due to gravity

C1 = a loss coefficient suggested from experimental data relating to exit geometry For a given velocity, the energy loss is shown to be directly related to the value of the loss coefficient. It is known that the loss coefficient for a sharp-edged orifice is approximately, C1 = 0.5, while for a chamfered outlet, C1 = 0.25, and for a smooth, gradual contraction, C1 = 0.05. While these values of the loss coefficient are approximate, they do not provide a general indication the magnitude of difference in energy loss and turbulence introduced by the exit geometries used in prior art.

The primary object of the present invention is to provide a nozzle which produces a laminar output stream suitable for water displays and fountains. A further object is to provide a laminar flow nozzle which minimizes flow disturbances within the nozzle to such a degree as to allow laminar flow at higher Reynolds number values than would normally be associated with laminar flow. Still another object is to provide a smaller, and thus more versatile, laminar flow nozzle suitable for water displays and fountains than is possible in the prior art and which is also less expensive to manufacture.

SUMMARY OF THE INVENTION

The present invention provides a nozzle producing a laminar output stream of fluid suitable for use in water displays and fountains. The present invention includes an enclosure with an inlet port, and out port, a discharge nozzle body having a discharge outlet passage therethrough, and a means for reducing turbulence within the enclosure by increasing the random and chaotic interaction of the fluid molecules to create a more uniform velocity profile across the flow area of the enclosure. The discharge outlet passage has a gradually reducing flow area to further reduce turbulence.

DETAILED DESCRIPTION OF THE INVENTION

Figure 4:
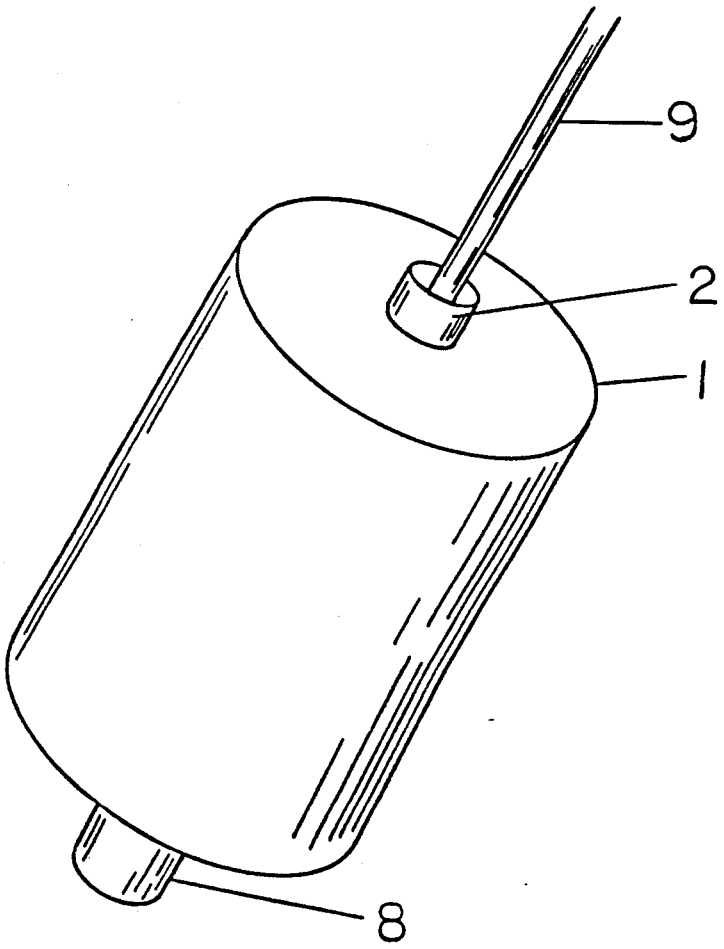
FIG. 4 is a perspective view of the present invention.

A preferred embodiment of nozzle of the present invention is shown generally in FIG. 4. The nozzle has an enclosure 1, generally a cylindrical tank, which includes an inlet port 8 and a discharge nozzle body 2. In FIG. 4, the fluid 9, typically water, is shown exiting the discharge nozzle body 2.

Figure 2:
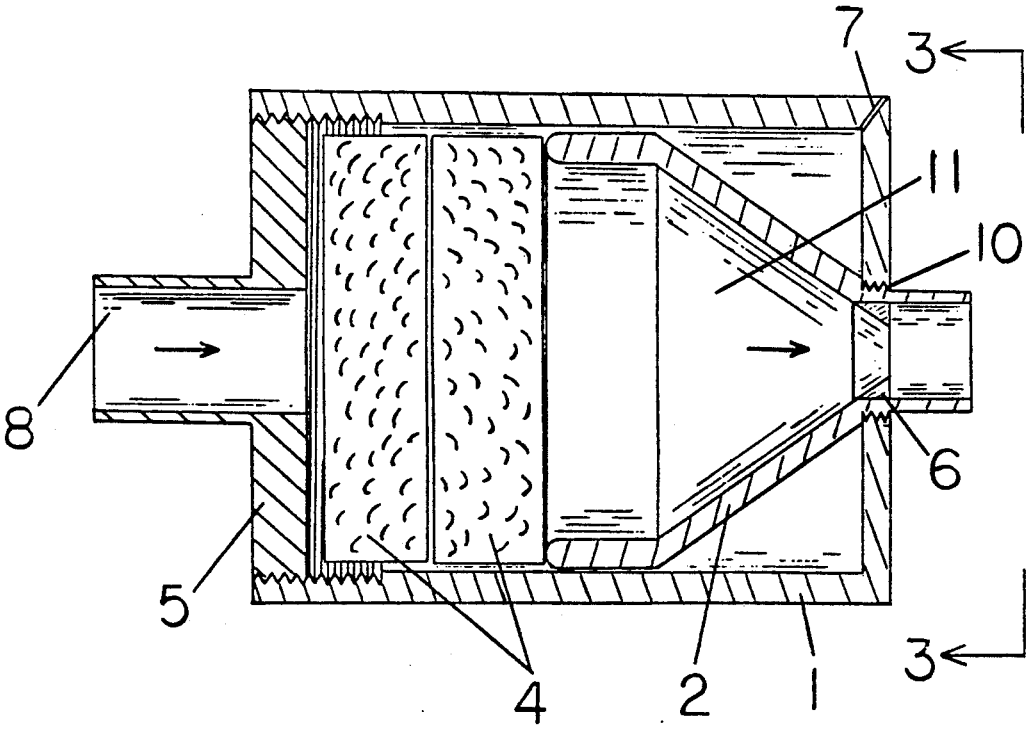
FIG. 2 is a cross-sectional view of the present invention.

FIG. 2 shows a cross-sectional view of the preferred embodiment of the invention. The invention includes an enclosure 1 having a rear cover plate 5 with an inlet part 8 at one end. An outlet port 10 is located essentially at the other end. A discharge nozzle body 2 having a discharge outlet passage 11 therethrough and a stainless steel outlet passage orifice 6 is interconnected to the enclosure 1 at the outlet port 10 with turbulence reducing means 4 located within said enclosure 1 to substantially eliminate turbulence and disturbances in the flow stream as it proceeds through the nozzle to produce a laminar output stream from the outlet passage orifice 6.

The turbulence reducing means shall consist of a column section 4 made up of short, randomly arranged filaments of any suitable material, which may be bonded together to form a columnar member by heat, solvent, or any suitable means.

The turbulence reducing means of the present invention provides a randomly-oriented series of filaments across the path of the incoming flow stream with no restricting cell walls or surfaces. The randomly-arranged filaments allows equal flow in all directions with only the pressure differential between the inlet supply stream and the laminar discharge stream defining a general flow path through the column. The open structure of the present invention also allows the incoming supply stream to be injected directly into the filament member rather than into an open chamber or plenum, reducing the formation of large or swirling turbulences.

Figure 1A:
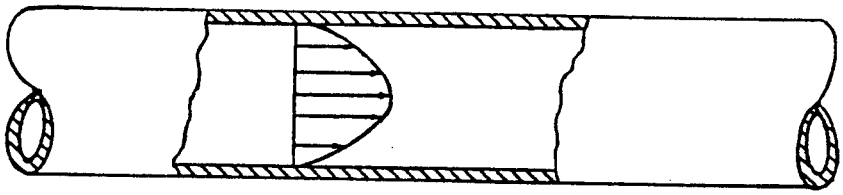
FIG. 1A is a velocity profile of laminar flow in a section of the pipe.
Figure 1B:
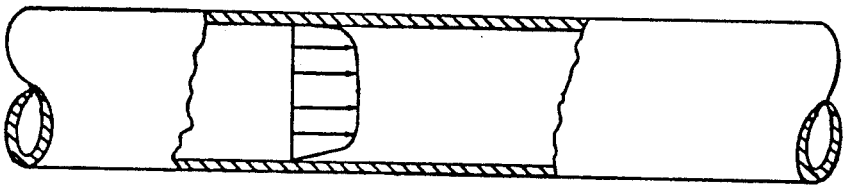
FIG. 1B is a velocity profile of turbulent flow in a section of the pipe.

Due to the viscosity of fluids and the type of flow (laminar or turbulent), the velocity profile of flow through a pipe or enclosure is non-uniform, with the maximum velocity at the center of the pipe. The velocity profile for laminar flow is parabolic, as shown in FIG. IA, due to the layered and regular nature of the flow. For turbulent flow, the velocity profile is relatively flat, as shown in FIG. 1B.

The present invention uses the velocity profile flattening property of turbulent flow to present a more uniform flow velocity profile to the discharge outlet passage 11. The filament column described in the present invention breaks up the turbulence which exists in the incoming supply stream into smaller components in all directions, the random and chaotic motion of the mixing fluid molecules results in the transfer of momentum between molecules. In this way, many radial components cancel each other out and a more uniform distribution, made up mainly of small axial components is formed. Any small remaining disturbances among these minute velocity components will quickly die out as the flow enters the discharge outlet passage 11. This combination of uniform velocity and small velocity components allow the present invention to maintain laminar flow at Reynolds number values well above even the critical range of 4,000.

One embodiment, made in accordance with the present invention, had filaments of between 1 and 2 thousandths of an inch (0.001–0.002) in diameter using a commercially-available substance known as Scotchbrite manufactured by 3-M Corporation. It was found that laminar flow was maintained at a Reynolds number value of over 8,000, using a flow of 10 gallons/min and a flow area diameter of 4 inches. The enclosure was a cylindrical tank 4 inches in diameter and 6 inches long. Thus, the entire device was much smaller than those allowed by the methods of prior art for the same flow. However, it will be appreciated that various materials may be advantageously used for the filaments of the present invention , e.g. nylon, plastic, polyester, polypropylene, and metal.

The flow then proceeds to the discharge outlet passage 11 which, in the preferred embodiment, is generally frusto-conical. This gradual contraction reduces turbulence as stated above by minimizing the energy loss due to the formation of a vena contracta. It also allows the flow to accelerate along the approximate shape of the parabolic laminar flow velocity profile while retaining the manufacturing ease associated with a conical section over a true parabolic section. It will be appreciated, however, that other shapes may be used, including a true parabola. A separate outlet orifice 6 made of stainless steel, has been added to maintain a sharp edge at the point of discharge.

Figure 3:
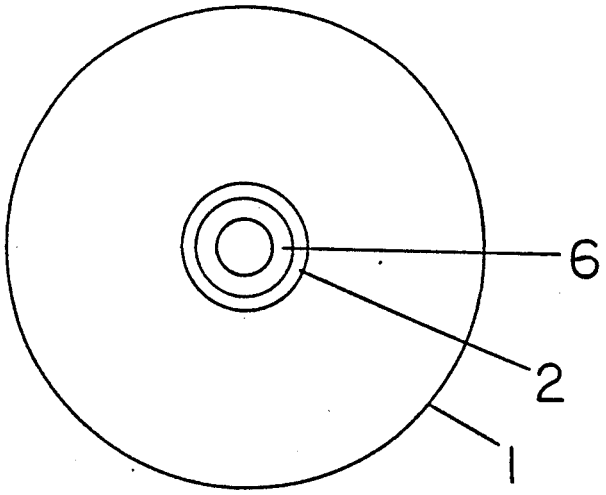
FIG. 3 is a top plan view of the present invention as shown in FIG. 2.

In a preferred embodiment, the enclosure 1 is a cylindrical tank as shown in FIG. 3, with the discharge outlet passage 11 being substantially concentric with the diameter of the enclosure 1.

A small vent 7 is provided to allow trapped air to escape which may cause pressure variations and break-up the flow of the stream. The vent 7 may simply be a small hole as shown or a floating check valve, or a piece of porous hydrophobic material which allows the free passage of air but prevents the passage of water at low pressures. The flow stream then exiting the discharge outlet passage 11 and the outlet passage orifice 6 is substantially free from turbulence and other disturbances and gives the appearance of a solid acrylic or glass arch.

I claim:

1. A fluid nozzle for producing a laminar output stream comprising:

an enclosure having an inlet port and an outlet port; a discharge nozzle body having a discharge outlet passage therethrough, said discharge outlet passage gradually reducing over its axial length to a flow area only a small fraction of the flow area of said enclosure and having a circular radial cross-section throughout; said discharge nozzle body being interconnected by a means for coupling, so that said discharge nozzle body can be easily removed, to said enclosure at said outlet port such that a flow path is defined between said inlet port and said discharge nozzle body and converging through said discharge outlet passage; and turbulence reducing means, located within said enclosure and across the flow path between said port and the smaller end of said discharge outlet passage, said turbulence reducing means being a dense columnar member comprised of filaments randomly-arranged throughout said columnar member for progressively dividing the velocity components of the incoming fluid into smaller components in all directions, promoting the transfer of momentum between the fluid molecules over the entire flow path of said columnar member, as the flow proceeds through said columnar member, whereby a more uniform velocity profile is produced and laminar flow is developed in said enclosure by minimizing disturbances in the flow stream, allowing laminar flow at higher flow rates than would normally be possible for the flow area of said enclosure.

2. The device of claim 1 wherein said enclosure is a cylindrical tank.

3. The device of claim 1 wherein said discharge outlet passage is a substantially frusto-conical passage.

4. The device of claim 1 further including means for removing air from said enclosure and said turbulence reducing means.

5. The device of claim 4 wherein said air removal means is a small hole in said enclosure with a piece or porous hydrophobic material interconnected to said enclosure allowing air to pass from said enclosure through said small hole but preventing the passage of water from said enclosure.

6. A laminar flow fluid nozzle capable of producing a substantially laminar output stream of sufficient cross-section and velocity for use in fountain displays comprising:

an enclosure having an inlet port and an outlet port;

a discharge nozzle body having a frusto-conical passage therethrough, said frusto-conical passage converging to a flow area only a small fraction of the flow area of said enclosure, and said discharge nozzle body being interconnected by a means for coupling, so that said discharge nozzle body can be easily removed, to said enclosure at said outlet port such that the larger diameter of said frusto-conical passage communicates with the interior of said enclosure, thereby defining a flow path between said inlet port and said discharge nozzle body, the flow path then converging through said frusto-conical passage; and turbulence reducing means within said enclosure and across the flow path between said inlet port and the smaller end of said frusto-conical passage, said turbulence reducing means being a columnar member comprised of filaments randomly-arranged throughout said columnar member for progressively dividing the velocity components of the incoming fluid into smaller components in all planes, promoting the transfer of momentum between the fluid molecules over the entire flow path of said columnar member, as the flow proceeds through said columnar member, whereby a more uniform velocity profile is produced and laminar flow is developed in said enclosure by minimizing disturbances in the flow stream, allowing laminar flow at higher flow rates than would normally be possible for the flow area of said enclosure.

7. The device of claim 6 wherein said enclosure comprises a cylindrical tank.

8. The device of claim 6 further including means for removing air from said enclosure and said turbulence reducing means.

9. The device of claim 8 wherein said air removing means is a small hole in said enclosure with a piece of porous hydrophobic material interconnected to said enclosure allowing air to pass from said enclosure through said small hole but preventing the passage of water from said enclosure.

10. A method of producing a laminar flow stream comprising the steps of:

(a) providing an enclosure having an inlet port and an outlet port;

(b) providing a nozzle body having a frusto-conical passage therethrough (c) interconnecting said nozzle body to said enclosure at said outlet port such that the large opening communicates with the interior of said enclosure; and (d) reducing the turbulence of the fluid within said enclosure by progressively dividing the velocity components of the fluid flow into many smaller components, some of which cancel each other, thereby presenting a more uniform flow profile through said enclosure.

11. The method of claim 10 further including:

removing the air from said enclosure and said turbulence reducing means.

* * * * *